United States Patent [19]

Neumann

[11] 4,098,480

[45] Jul. 4, 1978

[54] UNIVERSAL SHELF SYSTEM

[75] Inventor: Leonard H. Neumann, Omaha, Nebr.

[73] Assignee: Lozier Store Fixtures, Omaha, Nebr.

[21] Appl. No.: 735,887

[22] Filed: Oct. 26, 1976

[51] Int. Cl.[2] ..... A47G 29/02; E04G 3/08; E06B 7/28

[52] U.S. Cl. ..... 248/243; 211/153; 248/224.4

[58] Field of Search ..... 248/224.4, 248, 225.2, 248/243, 241, 73; 211/153

[56] References Cited

U.S. PATENT DOCUMENTS

| | | | |
|---|---|---|---|
| 1,983,470 | 12/1934 | Knape | 248/243 |
| 2,453,254 | 11/1948 | Odin | 248/243 |
| 2,820,551 | 1/1958 | Mount | 211/136 |
| 2,845,187 | 7/1958 | Bianchi | 211/136 |
| 3,135,491 | 6/1964 | Knape et al. | 248/243 |
| 3,151,576 | 10/1964 | Patterson | 108/2 |
| 3,184,200 | 5/1965 | McDonnell | 248/243 X |
| 3,186,668 | 6/1965 | Story | 248/225.1 X |
| 3,353,684 | 11/1967 | Chesley | 211/176 |
| 3,561,713 | 2/1971 | Berkowitz | 248/242 |
| 3,643,607 | 2/1972 | MacKenzie | 108/111 |
| 3,697,034 | 10/1972 | Shell | 248/243 |
| 3,779,499 | 12/1973 | Shell | 248/224.4 |
| 3,827,377 | 8/1974 | Aughtry, Jr. | 108/108 |
| 3,832,957 | 9/1974 | Mendenhall | 108/64 |
| 3,983,822 | 10/1976 | Suttles | 248/224.4 |

FOREIGN PATENT DOCUMENTS

| | | | |
|---|---|---|---|
| 279,244 | 9/1967 | Australia | 248/243 |

*Primary Examiner*—James T. McCall
*Attorney, Agent, or Firm*—Cushman, Darby & Cushman

[57] ABSTRACT

The invention relates to a universal shelving system including slotted conventional upright supports, bracket assemblies for interengaging slots of the upright supports, and shelf members having uninterrupted upper surfaces for supporting goods thereon, and being supported on the underside thereof by the bracket assemblies. Hat-shaped sections are provided on the underside of the shelf members for providing reinforcement for the shelf members and for providing a surface for supporting engagement by the bracket assemblies. Each bracket assembly includes a bracket tab section for attachment to an upright support, and a bracket arm section pivotally mounted to the bracket tab section. A pivoted spring clip detent means is attached either to the tab section or the arm section, and cooperates with detent openings in the other of the sections. The bracket assembly is able to support even large loads without spreading apart of the tab and arm sections since a slot and rivet cooperating structure is provided therewith. Hinge clips are provided for attaching the bracket arms to the hat-shaped sections, cooperating elongated slots being provided in the hat-shaped sections and the bracket arms for interengagement with the hinge clips. The hinge clips normally securely (without any relative lateral movement) hold the bracket arms in perpendicular relationship to the hat-shaped sections, however the hinge clips may support the bracket arm flush against the bottom of the hat-shaped sections for ease of packaging or storage of the shelf assemblies.

6 Claims, 10 Drawing Figures

Fig. 2
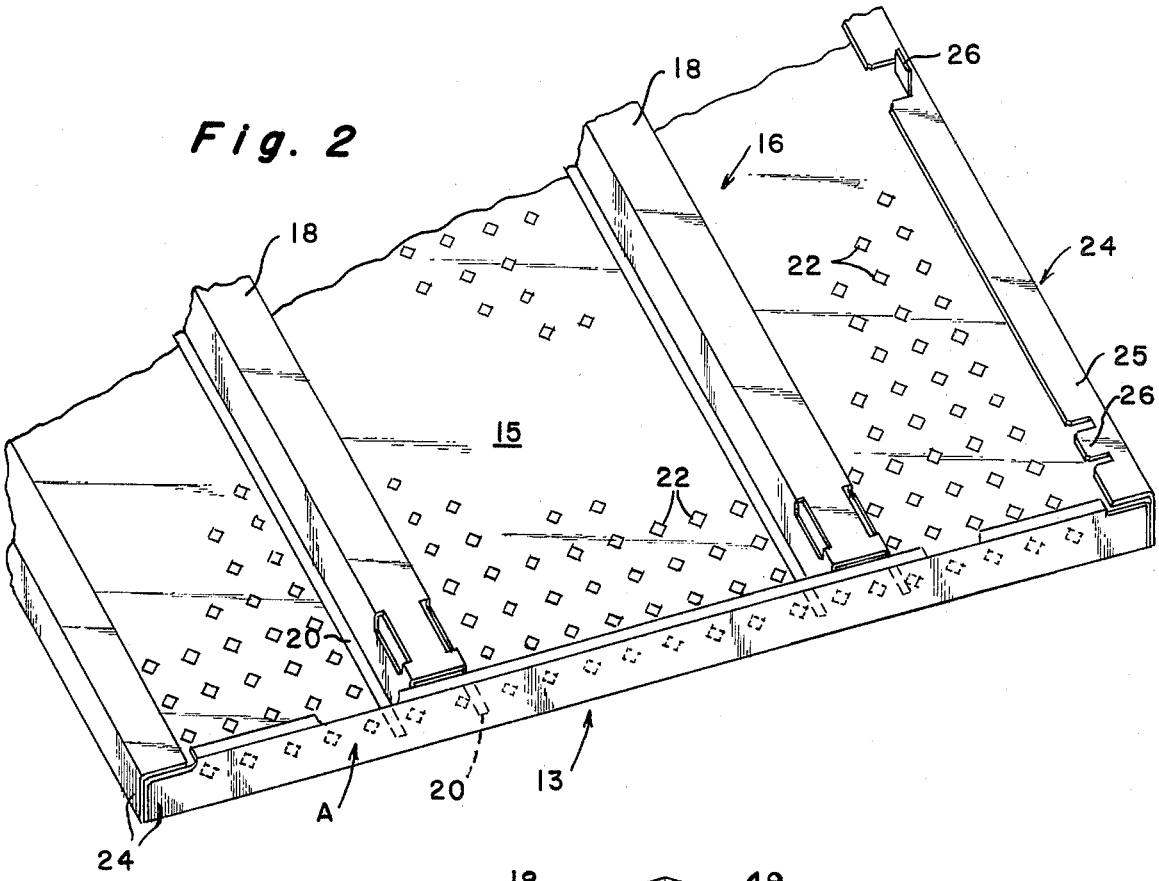
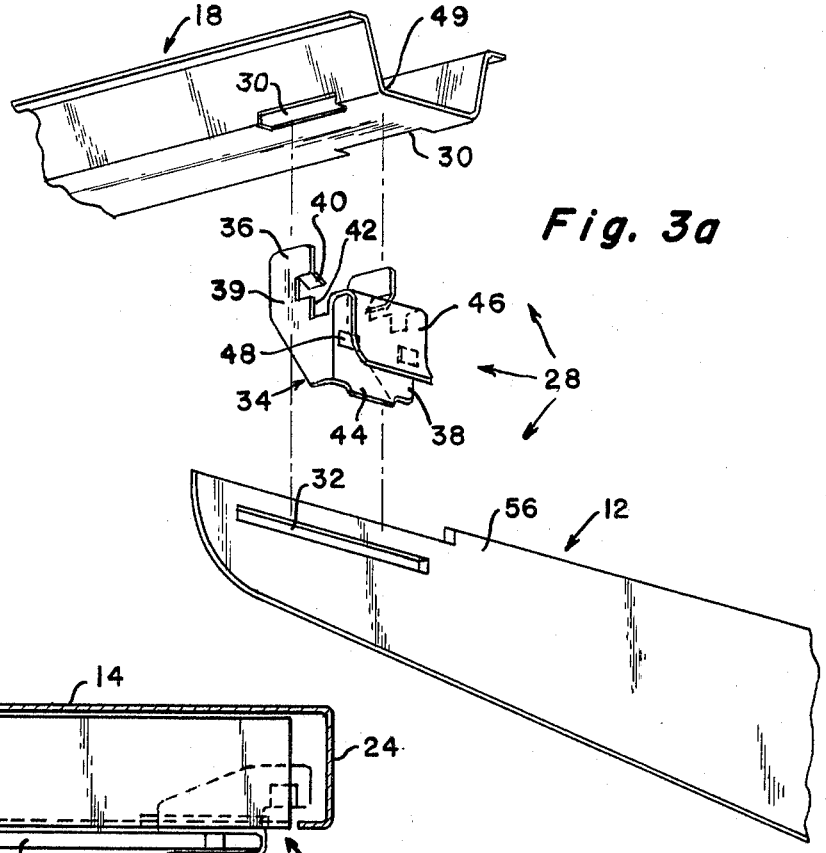
Fig. 3a
Fig. 3b
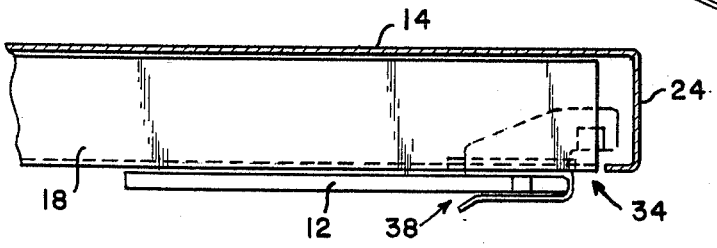

UNIVERSAL SHELF SYSTEM

BACKGROUND AND SUMMARY OF THE INVENTION

It has long been considered desirable to provide a truly universal shelving system wherein the component parts are utilizable with a maximum number of other standard components, all of the components are simply and easily constructed yet provide for secure attachment of the component parts together, and wherein easy assembly and ready packaging of the component parts are provided. In particular, it has been considered desirable to form shelf members with a minimum of effort yet which will provide maximum adjustability and maximum strength. There has been a need for universal shelving systems wherein bracket assemblies can be readily and adjustably attached to shelf members yet securely hold the shelf members against lateral movement, and there has been a need for bracket assemblies which are readily adjustable to a number of different angular positions yet provide a high load rating, and there has been a need to provide a simple means for attaching the bracket assemblies to the upright supports, yet providing a difficult arrangement for the detachment of the brackets from the supports so that accidental dislocation of a shelf is unlikely.

It is believed that according to the present invention all of the above-mentioned needs have been fulfilled, and a truly universal shelving system has been provided which has many advantageous results over prior art systems and components. In particular, according to the present invention, a continuous upper surface, strongly reinforced shelf member has been provided, the shelf having continuous diamond perforations formed in a regular pattern thereon, and the reinforcement structure therefor — although properly reinforcing the shelf member — not interfering with the utilization of any of the diamond perforations. Readily formable (on standard metal forming equipment) hat-shaped sections provide the multiple function of reinforcement of the shelf member and a surface for support of the shelf member by bracket assemblies. Stabilizing tabs for preventing lateral instabilitya of the shelves on conventional bracket arms with which the shelf member may be utilized are provided associated with the shelf member, which stabilizing tabs are not necessary when bracket assemblies according to the present invention are utilized therewith. The hat-shaped sections are spaced to correspond to conventional bracket lengths for providing ready utilization of conventional bracket arms with the shelf members, and the hat-shaped sections are welded to the underside of the goods-supporting surface of the shelf member in non-interfering relationship with the diamond-shaped perforations of the shelf.

Also, according to the present invention, a system is provided for ready attachment of the shelf members to bracket assemblies according to the present invention, and a wide range of adjustability is provided therein for utilization of both the bracket assemblies and shelf members with a wide variety of sizes of corresponding components. At the same time, no relative lateral movement is allowed between the shelf members and the bracket assemblies, and the bracket assemblies may be held flush against the shelf members so that no portions thereof protrude beyond the perimeter of the shelf members for ease of packaging and/or storage of the components. Interengagement between the shelf members and bracket assemblies is provided by hinge clip members which readily clip into place in adjustable positions of the bracket arms and hat-shaped sections of the shelf members.

According to another feature of the present invention, the bracket assemblies are provided in two sections, a bracket arm and a bracket tab section, the two sections being pivotal with respect to each other so that a shelf may be supported in a wide number of angular positions with respect to the horizontal. Detent means are provided for latching the arm and tab sections in particular angular positions to which they are moved and for providing secure attachment thereof in those positions while still allowing ready disengagement of the detent to move the structures to another position. A slot and rivet structure is provided for maintaining the arm and tab sections in abutting engagement so that they cannot spread apart even under heavy loading. Additionally, according to the present invention, the tab sections are constructed so that they may readily be inserted in any conventional one-inch O.C. slotted tubing upright, yet once they are inserted into place it is difficult to accidentally disengage them. Beveled diverging surfaces are provided between locking flanges of the tab sections and the bodies of the tab sections for providing a no-interference area facilitating the ease of insertion of the structures into place, and a lock step is provided on one of the diverging surfaces for preventing detachment of the locking flanges upon an upward tilting movement of the assembly without significant upward movement preceding the tilting movement. Additionally, stabilizing means are provided on the tab section for supporting the bracket arms, which stabilizing means also provide a stop for the downward relative movement of the bracket arm with respect to the tab section.

It is a primary object of the present invention to provide an improved truly universal shelving system. This and other objects of the invention will become clear from an inspection of the detailed description of the invention and from the appended claims.

BRIEF DESCRIPTION OF THE DRAWINGS

FIG. 2 is a bottom perspective view of an exemplary shelf member utilizable in the shelving system according to the present invention;

FIG. 3*a* is an exploded perspective view of structure for the interconnection of the shelf and bracket assemblies according to the present invention for providing supporting engagement of the shelf by the bracket assemblies, and FIG. 3*b* is a side view with portions of the shelf member in section, showing attachment of a bracket assembly to a shelf member for ease of packaging and/or transport thereof;

DETAILED DESCRIPTION OF THE INVENTION

Figure 1:
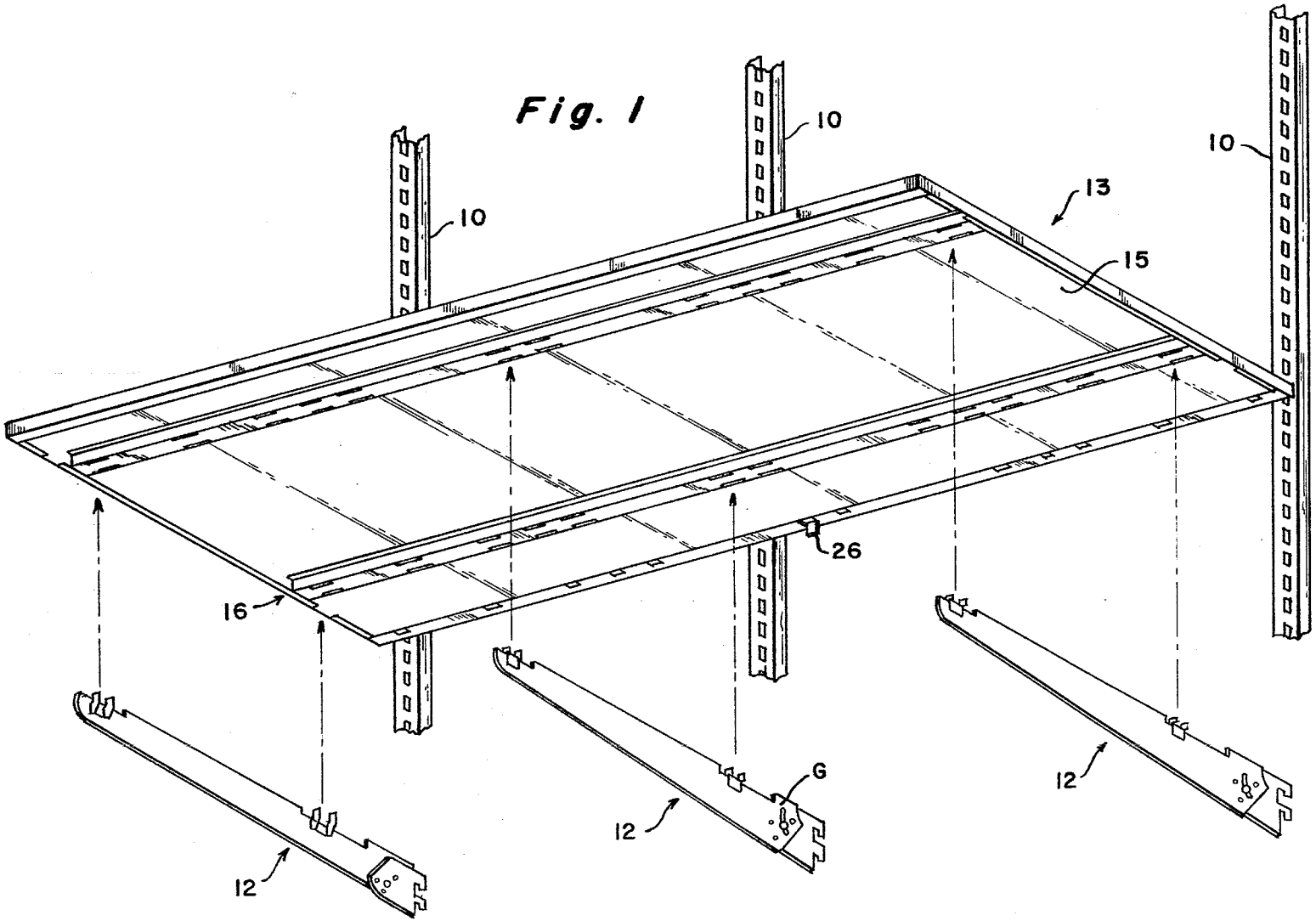
FIG. 1 is a perspective view of an exemplary shelving assembly according to the present invention.

A universal shelving system according to the present invention is shown in FIG. 1. The assembly generally includes three major components, a plurality of conventional slotted uprights 10 which may be any standard one-inch O.C. slotted components except recessed slot extruded components, bracket assemblies 12, and one or more shelf members 13. Each of the shelf members 13 has an uninterrupted upper surface 14 thereof for supporting goods thereon, and has an underside 15 thereof. Disposed on the undersurface 15 are a plurality of reinforcement and supporting means 16, the reinforcement and supporting means 16 preventing bending of the shelf members 13 under heavy loads, and providing a surface for engagement with the bracket structures 12. The means 16 include a number of spaced, generally parallel hat-shaped sections 18, the sections 18 lying generally transversed to the slotted uprights 10. The hat-shaped sections are formed separately from the shelf members 13, and are attached to the underside 15 at spaced points 20, the attachment preferably being made by welding. The hat-shaped sections are formable on standard metal forming equipment. The term "hat-shaped" as used herein is intended to mean a structure having a cross-sectional shape generally like that of a hat, as shown most clearly in FIGS. 3*a* and 4*a*, a space being provided between the underside 15 of the shelf members 13 and the bracket structure engaging portion of the section 18. The shelf member 13 preferably has a continuous pattern of diamond-shaped perforations formed therein with a constant centerline, and the spaced portions 20 for attaching the sections 18 to the underside 15 of the shelf member 13 do not interfere with any of the perforations 22 and the shelf member 13 as shown clearly at A in FIG. 2. Thus, all of the diamond-shaped perforations 22 are utilizable rather than just some of them, as is conventional in the prior art. Additionally, it is desirable to mount the perforations 22 on one-half inch centerlines so that the location of the perforations 22 on laterally adjacent shelves 13 installed in fixtures continues uninterrupted from shelf to shelf on the one-half inch centerline, allowing modular application of hardware (typical to the industry) across adjacent shelf joints.

Additionally, downwardly extending border edge portions 24 are provided for the shelf member 13, the portions 24 being formed of the same sheet of material as the top 14, the portions 24 merely being bent downwardly from the top 14. The portions 24 extend downwardly from the top 14 a distance substantially the same as the height of the hat-shaped sections 18. Also, so that the shelf member 13 may be readily utilized with bracket arms conventionally on the market while still providing a stable structure, tab portions 26 are formed in the edge border portion 25 adapted to be located adjacent the uprights 10. When the shelf members 13 are utilized with the bracket structures 12 according to the present invention, the tabs 26 extend generally parallel to the underside 15 of the shelf member 13, however when conventional bracket arms are utilized therewith the tabs are bent downwardly so that they are perpendicular to the underside 15 (see the top tab 26 in FIG. 2), in which position the tab portions 26 engage the side faces of bracket arms supporting the shelf member 13, thereby laterally stabilizing the shelf on the bracket arms.

Figure 4A:
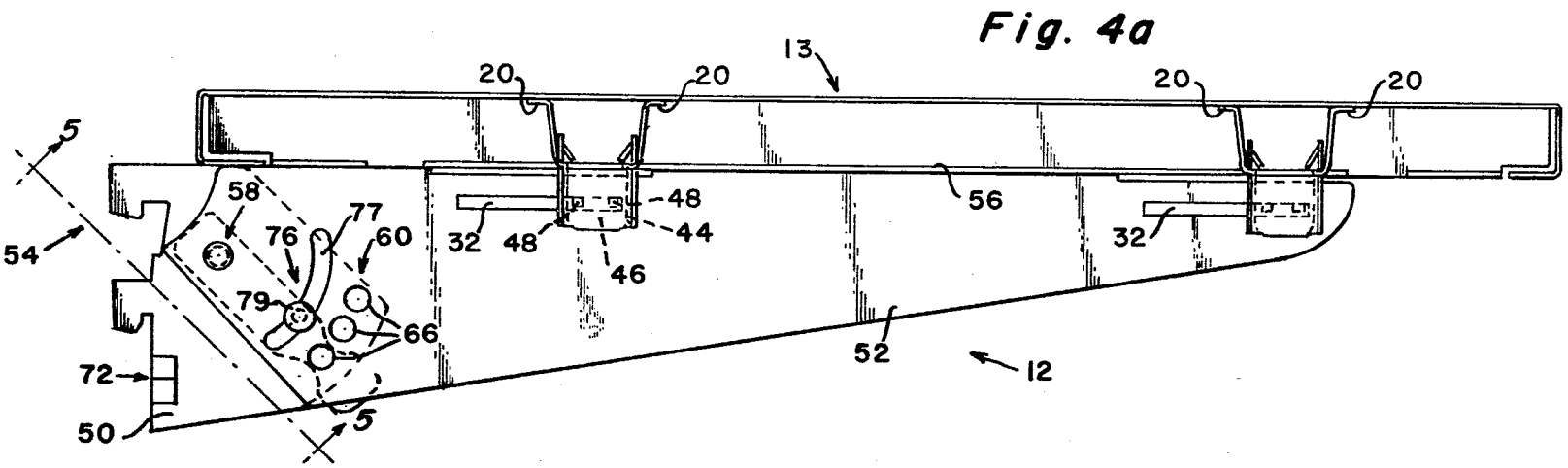
FIG. 4*a* is a detailed side view showing the interconnection of a bracket assembly to a shelf member according to the present invention, and showing exemplary detent structures according to the invention.

In order to effect secure attachment of the bracket assemblies 12 to the shelf member 13 so that the bracket structures 12 are substantially perpendicular to the hat-shaped sections 18 and so that no relative lateral movement therebetween is possible, attaching means 28 are provided. The attaching means 28 include a plurality of slots 30 for receiving a hinge clips assembly 34 and the hat-sections 18, and a plurality of slots 32 for receiving the hinge clips assemblies 34 in the bracket structures 12. The openings 30 and 32 are elongated to provide for numerous readily adjustable relative positions between the hinge clips assemblies 34 and structures 12 and 18, to accommodate bracket structures and shelf members of different sizes. The elongated slots 30 provide a lateral tolerance to accommodate various centerline mountings of conventional slotted upright standards 10 presently on the market. Each of the hinge clips 34 comprises a first section 36 for cooperation with a hat-shaped section 18, and a second section 38 for cooperation with the bracket structure 12. The first section 36 comprises a pair of plate portions 39 (see FIGS. 3a and 4a in particular) adapted to extend through the slots 30 into the interior of the hat-shaped sections 18, and each plate 39 having a lock tab 40 formed thereon. When the hinge clips 34 are in locking position with the bracket structure 12 and shelf member 13 (as shown in FIG. 4*a*) the lock tabs 40 dig into the inside surface of the hat-shaped sections 18 and prevent relative movement between the sections 18 and hinge clips 34. The second section 38 is generally U-shaped (see FIGS. 3*a* and 3*b* in particular) having a pair of leg portions 44, 46. One of the legs (44) has lock tabs 48 disposed thereon, and one of the legs (46) is made of spring material so that when a bracket structure 12 is received by second section 38, the legs are disposed on either side of the bracket structure 12 and the tabs 48 extend into slot 32, the spring leg 46 applying a pressure holding the lock tabs 48 in place.

The size and position of the slots 30 in the hat-shaped sections 18 are so chosen, and the relative dimensions of the hat-shaped sections 18 and hinge clips 34 are chosen, so that a hinge clip cooperating with each slot 30 may be pivoted to a position wherein the first section 36 is disposed interiorly of the section 18, as shown in FIG. 3*b*. Additionally, the hinge clip assemblies 34 are each so structured so that they have a supporting portions 42 thereof, which supporting portion 42 engages a surface 49 of hat-shaped sections 18 so that the legs 44, 46 of the second section 38 are generally parallel to the underside 15 of shelf member 13. In this position, a bracket structure 12 can be received by the second section 38 (with lock tabs 48 disposed through slot 32 and structure 12) so that the bracket structure 12 is flat against the underside of the hat-shaped sections 18, parallel to the underside 15 of shelf member 13. In this way, the hinge clips 34, shelf members 13, and bracket structures 12 can all be packaged in a flat configuration, the brackets 12 and hinge clips 34 essentially being contained within the perimeter of the shelf member 13, for ease of packaging and/or storage. This low-volume configuration packaging, which is readily convertible to the supporting structure, is extremely advantageous in practice.

Although according to some aspects of the present invention the brackets structures 12 may be formed of one piece, extending generally perpendicular to the slotted uprights 10 for supporting the shelf members 13, it is desirable for many applications that the shelf members 13 be disposable at various angles with respect to the horizontal (such as 15° above horizontal, and 15°, 30°, and 45° below horizontal, as well as horizontal). To provide such relative positioning, each bracket assembly includes a bracket tab section 50, and a bracket arm section 52 having an upper supporting surface 56 thereof adapted to support shelving (13) thereon, and means 58 for pivotally connecting the bracket arm section 52 to the bracket tab section 50. The bracket tab section 50 has connecting means 54 associated therewith for supporting the sections 50, 52 in conventional upright standards 10. The pivotally connecting means 58 preferably comprises a simple pivot pin 59 (see FIG. 5) connected to both members 50 and 52, the member 52 being freely pivotal about pivot pin 59 with respect to member 50.

Figure 5:
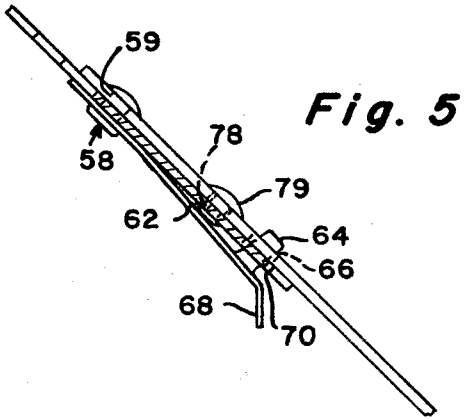
FIG. 5 is an end view taken along lines 5—5 of FIG. 4*a* showing a detent and pivotal supporting arrangement according to the present invention in detail.
Figure 4B:
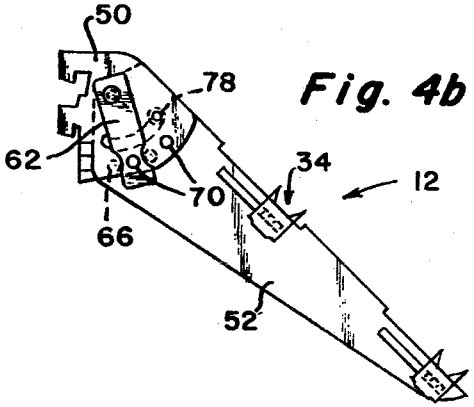
FIG. 4*b* is a view similar to FIG. 4*a* only with the shelf structure removed, and showing a bracket assembly in a different angular position than is shown in 4*a;*

According to the present invention, detent means 60 are provided for maintaining the arm section 52 in various angular positions to which it is moved with respect to tab section 50, the detent means 60 being constructed so that positive detenting action is provided thereby, yet the relative angular positions between the sections 50 and 52 can be readily and easily changed. The detent means 60 comprises a spring clip 62 having one end thereof secured to either said arm section or said tab section (as shown in FIGS. 4*a*, 4*b* and 5 it is preferably connected to the tab section 50), and having a detent pin 64 disposed adjacent the other end thereof. A plurality of openings 66 are provided in the other of said tab section 50 and arm section 52 than the section to which the spring clip 62 is connected (the openings 66 for receiving detent pin 64 are shown formed in the arm section 52 in FIGS. 4*a* and 4*b*) to positively hold the arm and tab sections 50, 52 in the relative pivotal positions to which they have been moved. One or more openings 70 are also provided in the member to which the spring clip 62 has been connected (as shown in the drawing tab section 50) to receive the detent pin 64 as the detent pin 64 passes therethrough to a receiving opening 66 formed in the arm section 52. Preferably, two openings 70 are provided in section 50 while two openings 66 are provided in section 52, and the spring clip 62 is pivotally mounted with respect to the sections 50, 52 (about the same pivot pin 59), so that a minimum number of openings need be provided in the two members 50, 52 to provide the maximum number of relative pivotal positions. For instance, by providing two openings 70 in section 50, and two openings 66 in section 52, four different "standard" angular positions can be provided between the sections 50, 52 (i.e., 15° above horizontal, horizontal, and 15°, 30° and 45° below horizontal). FIG. 4*b* shows a bracket assembly 12 wherein the arm section 50 is disposed at an angle of 45° downward from the tab section 50. The assembly 12 shown in FIG. 4*b* differs from that shown in FIGS. 4*a* and 5 only in that it discloses a right-hand adjustable bracket assembly rather than a left-hand adjustable bracket assembly as in FIGS. 4*a* and 5.

Figure 6A:
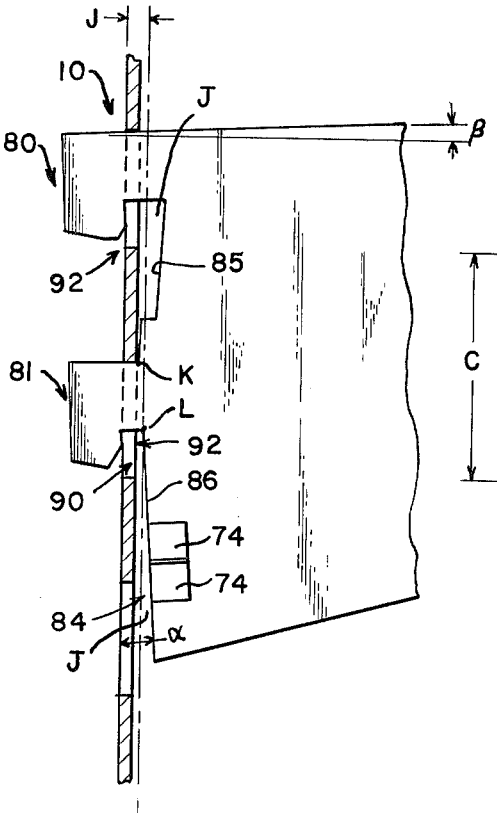
FIG. 6*a* is a schematic showing of a bracket assembly according to the present invention during insertion thereof into a conventional slotted upright.
Figure 6B:
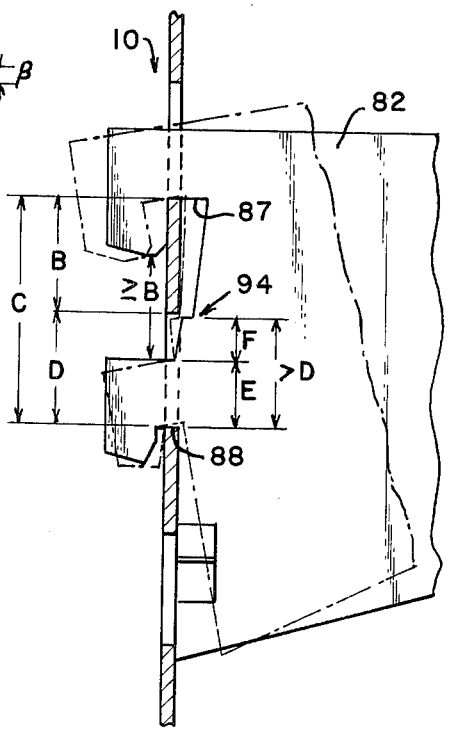
FIG. 6*b* is a showing of the bracket assembly locked in position with the upright, and in dotted line showing the anti-accidental disengagement feature according to the invention.
Figure 6C:
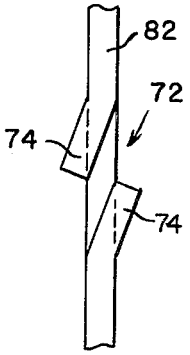
FIG. 6*c* is an end view of the bracket assembly of FIGS. 6*a* and 6*b* showing the stabilizing structure thereof.

It is desirable that some sort of stabilizing means be provided for the bracket assemblies 12 to ensure secure attachment thereof to the upright supports 10. According to the present invention, such stabilizing means, shown at 72 in FIGS. 4*a* and 6*c*, are formed from the bracket tabs 50 adjacent a bottom portion thereof. When located in such a position, the stabilizing means 72 also comprise stopping means for limiting the downward pivotal movement of the arm section 52 with respect to the tab section 50 (see FIG. 4*b*). The means 72 preferably are shear-formed directly from the material forming the bracket assembly (see FIG. 6*c*). The ear tabs 74 that are shear-formed are formed to at least the material thickness as clearly shown in FIG. 6*c*. By forming them in this manner, the ears 74 provide for maximum stabilization, positively stop the relative pivotal movement of the section 52, yet do not significantly weaken the section 50.

Means 76 are provided associated with the sections 50, 52 for guiding the sliding pivotal movement of the bracket arm section with respect to the bracket tab section, and for preventing the spreading apart of the arm and tab sections under heavy loads. The means 76 include a slot 77 formed in one of the arm and tab sections 50, 52 and a rivet 78 attached to the other of the arm and tab sections 50, 52 and extending through the slot 77, an abutment 79 being provided on the rivet for engagement of the section in which the slot is formed. As shown in the drawings, the slot 77 is formed in the arm section 52, while the rivet 78 is attached to the tab section 50 and extends through slot 77, rivet abutment 79 being disposed against arm section 52 on the opposite side of section 52 from section 50. Such an arrangement provides a simple foolproof structure for the prevention of spreading apart of the sections 50, 52, while not interfering with the pivotal relative movement therebetween.

Additionally, it is noted also that the spring clip 62 has an inclined portion 68 formed at the free end thereof for facilitating ready movement of the spring clip to allow displacement of the detent pin 64 out of the openings 66 and/or 70.

According to the present invention, the bracket structures 12 are connected to the upright standards 10 by means which allow easy insertion of the brackets through the slots of the standards 10, yet minimize the chances of a shelf accidentally being knocked out of the upright slots. Such structures are shown most clearly in FIGS. 6*a* and 6*b*. The slotted upright support 10 has at least two spaced slots formed in one face thereof, the slots being spaced from each other a vertical distance B. A bracket body 82 (which may comprise either a complete bracket structure 12, or a bracket tab section 50 as shown in FIGS. 4*a* and 4*b*) has an upper locking flange 80 and a lower locking flange 81 associated therewith for insertion into the slots of the upright 10. The bottom of the upper flange 80 is spaced a distance greater than or equal to B from the top of the lower flange 81 (see FIG. 6*b*). Means — shown generally at 84 in FIG. 6*a* — are disposed between the flanges 80, 81 for providing an interference-free area (see area J in FIG. 6*a*) to allow the bracket 82 to drop freely into place in locking engagement with the upright support 10. The means 84 include beveled edge surface portions including a first beveled edge surface portion 85, and a second beveled edge portion 86, both edge portions 85, 86 extending away from the lower locking flange 81 and upright support 10. As can be seen by an inspection of FIG. 6*a*, only the point K of the bracket assembly 82 can possibly contact the upright 10 during insertion, and once point K is contacted, the flanges 80, 81 may be readily dropped into interlocking engagement (as shown in solid line in FIG. *6b*). It is noted that the body 82 is tilted upwardly slightly (such as an angle $\alpha$ from the horizontal) as the flanges 80, 81 are inserted into the slots in the upright 10, the second beveled surface 86 not interfering with the upright 10 in this tilted position, and once the flanges 80,81 are in place, the second beveled surface 86 engages the face of the upright 10 (along with the stabilizing means 72) to provide the proper support. As can be seen from an inspection of FIG. *6b*, it is desirable that the upper locking flange 80 engage the inside surface of the upright 10, while the lower flange 81 is spaced slightly from the upright 10 in the horizontal dimension. The beveled surface 86 may have an angle of bevel of $\alpha$.

The locking flanges 80,81 have upright engaging surfaces 87,88 respectively thereof, the surface 87 engaging the bottom surface of the top slot of upright 10, and the surface 88 engaging the lower surface of the lower slot in upright 10. The engaging surfaces 87,88 of the hook-shaped portions 92 of the flanges 80,81 are spaced the distance C from each other (see FIG. *6b*), wherein C is equal to the distance B plus the length D of the upright slot 90 cooperating with the lower flange 81.

The first edge surface 85 has means 94 formed thereon for preventing removal of the locking flanges 80, 81 from the upright slots upon an upward tilting movement of the bracket assembly 82 before significant upward movement of the flanges 80,81 parallel to the upright assembly 10. The means 94 includes a locking step (see FIGS. *6a* and *6b*). As shown in dotted line in FIG. *6b*, should the bracket 82 (and the shelf 13 supported thereby) receive any lifting action forward of the center of gravity thereof, a "tip-up" action will necessarily result, which tip-up action will cause the lock step 94 to engage the upper surface of slot 90 (see dotted line in FIG. *6b*), and which will prevent further upward movement of the bracket 82 so that it cannot be accidentally dislodged from the upright slots. The lock step 94 is formed a vertical distance F above the uppermost surface of the lower locking flange 81 along the edge surface, and the uppermost surface of the locking flange 81 is spaced a distance E from the engaging surface 88 thereof, so that E plus F is less than D.

In conclusion, it is respectfully submitted that according to the present invention an improved truly universal shelving system has been provided, and one that has numerous advantages over the prior art including easy-in, difficult- out locking flanges associated with the bracket structures; adjustable, readily securable attachment means for attaching the bracket structures to the shelf members, which attaching means do not allow any lateral movements therebetween; angularly movable bracket arm portions that allow the positioning of the shelves in various angular positions with respect to the horizontal even under heavy loading; readily releasable and changeable yet secure detent means for locking the bracket structures in their relative angular positions; and multiple function supports for the shelves cooperating with the bracket members, and providing for a low-volume packing configuration of the structures. While the invention has been herein shown and described in what is presently considered to be the most practical and preferred embodiment thereof, it will apparent to those of ordinary skill in the art that many modifications may be made thereof within the scope of the invention, which scope is to be accorded the broadest interpretation of the appended claims so as to encompass all equivalent structures and devices.

What is claimed is:

1. A shelf supporting assembly comprising (a) a slotted upright support having at least two spaced slots formed in a face thereof, said at least two slots being spaced from each other a vertical distance B, and (b) a bracket assembly for connection to said upright support to extend generally perpendicular to said support face, and for supporting a shelf extending generally perpendicular to said upright support, said bracket assembly including (i) a pair of locking flanges vertically spaced from each other and the bottom of the topmost flange being spaced a distance $\geqq$ B from the top of the bottommost flange, (ii) a bracket body portion, and (iii) means disposed between said flanges and said body portion for providing an interference free area to allow said bracket assembly to drop freely into place in locking engagement with said upright support, said means including beveled edge surface portions of said bracket body portion adjacent said bottommost locking flange on either side thereof, and extending away from said bottommost locking flange and said upright support.

2. A shelf supporting assembly as recited in claim 1 wherein each of said locking flanges comprises a hook-shaped portion having an upright engaging surface thereof for supporting said bracket body when in locking engagement with an upright support, said engaging surfaces of said hook-shaped portions being spaced a distance C equal to the distance B plus the length D of the slot of said upright support cooperating with said bottommost locking flange.

3. A shelf supporting assembly as recited in claim 1 further comprising means formed on said bracket body portion for stabilizing said bracket assembly when it is locked with said upright support, said means comprising a pair of ears formed from said body portion and extending outwardly from either face thereof.

4. A shelf supporting assembly comprising (a) a slotted upright support having at least two vertically spaced slots formed in face thereof, said slots being spaced from each other a vertical distance B, and the lowermost of said slots having a length D, (b) a bracket assembly for connection to said upright support to extend generally perpendicular to said support face, and for supporting a shelf extending generally perpendicularly to said upright support, said bracket assembly including (i) a pair of locking flanges vertically spaced from each other and including hook-shaped portions having upright engaging generally horizontal surfaces thereof for supporting said bracket body when in locking engagement with an upright support, said engaging surfaces of said hook-shaped portions being spaced a distance C from each other wherein $C=B+D$, and wherein the uppermost surface of said bottommost locking flange is spaced a distance E from said engaging surface of said bottommost flange, (ii) a first edge surface generally extending between the uppermost surface of said bottommost flange and said engaging surface of the uppermost flange, and (iii) means formed on said edge surface for preventing removal of said locking flanges from said upright slots upon an upward tilting movement of said bracket tab assembly before significant upward movement of said locking flanges parallel to said upright assembly.

5. An assembly as recited in claim 4 wherein said means formed on said edge surface comprise a lock step formed a vertical distance F above the uppermost surface of said bottommost locking flange along said edge surface, wherein $E+F<D$.

6. An assembly as recited in claim 4 wherein a second edge surface is provided extending from the engaging surface of said bottommost flange toward the bottom, said second edge surface extending at an angle $\alpha$ less than 90° with respect to said engaging surface so that said bracket tab assembly is tilted a positive angle $\beta$ with respect to the horizontal when the locking flanges are inserted into the slots in the upright, said second edge surface abutting said upright when said locking flanges are locked into place.

* * * * *